US007413137B2

(12) United States Patent
Donovan

(10) Patent No.: US 7,413,137 B2
(45) Date of Patent: Aug. 19, 2008

(54) MANUAL PILL CRUSHER

(75) Inventor: James A. Donovan, 8805 Roberts Rd., Odessa, FL (US) 33556

(73) Assignee: James A. Donovan, Tarpon Springs, FL (US)

( * ) Notice: Subject to any disclaimer, the term of this patent is extended or adjusted under 35 U.S.C. 154(b) by 23 days.

(21) Appl. No.: 11/525,571

(22) Filed: Sep. 21, 2006

(65) Prior Publication Data

US 2008/0093490 A1 Apr. 24, 2008

(51) Int. Cl.
*B02C 19/00* (2006.01)

(52) U.S. Cl. ..... 241/168; 241/169.2; 241/DIG. 27

(58) Field of Classification Search ..... 241/DIG. 27, 241/270, 168, 169.2
See application file for complete search history.

(56) References Cited

U.S. PATENT DOCUMENTS 4,763,847 A 8/1988 Vosburgh
5,531,386 A * 7/1996 Jensen ..... 241/36
5,915,637 A * 6/1999 Parsons ..... 241/168
6,059,209 A * 5/2000 Barson ..... 241/168
6,637,685 B1 10/2003 Kruger

OTHER PUBLICATIONS

Official Search Report of the Patent Cooperation Treaty in counterpart foreign Application No. PCT/US07/20313 filed Sep. 19, 2007.

* cited by examiner

*Primary Examiner*—Mark Rosenbaum
(74) *Attorney, Agent, or Firm*—Kinney & Lange, P.A.

(57) ABSTRACT

A manually operable pill crusher device for use with pill pouches. A base includes a crushing surface over which a head is mounted. A handle is attached to a cam inside the head, and the head has a slot that permits the handle to move from a horizontal position to a vertical position. The cam is mounted inside a ram which slideably moves axially inside the head from a raised position in the head when the handle is vertical to a lowered position when the handle is horizontal. The ram includes a crushing surface engaging surface. The head also includes a slot through which a pill in a pouch can be inserted on to the crushing surface when the handle is raised. Lowering the handle then crushes the pill with axial force directly over the crushing surface, avoiding any cocking or arcuate pressure on the pill.

14 Claims, 3 Drawing Sheets

MANUAL PILL CRUSHER

FIELD OF THE INVENTION

This invention relates to a manual pill crusher device used to pulverize pills and other small objects for ease in taking prescribed and over the counter medicines. More particularly, the invention relates to a pill crusher that has improved ease of operation.

BACKGROUND OF THE INVENTION

In many instances, persons needing to take medicine on a regular basis need to take it in liquid form, for various reasons. The patient may have difficulty swallowing or the taste of the medicine in pill form is unpleasant. In some cases, there is a need to disguise the existence of the medicine, such as for a child under the care of a nurse or doctor.

It is also common for a person to take more than one medicine at one time, such as a medicine to regulate blood pressure and another to reduce cholesterol. Vitamins and other supplements may also be taken at that time. Patients may prefer to take all of the medicine one liquid form, rather than taking a number of pills separately.

In hospitals, nursing homes and extended care facilities, the nurse or other attendant may have a large number of patients to treat on a daily basis. Reducing medication to a single does increases efficiency and reduces costs.

There are a number of medicines that come in pill form only. In any of these situations, it has become a common practice to crush or pulverize the pills, keeping them in a pouch or bag. One example of an effective bag or pouch for pills that are to be crushed or pulverized is shown in my co-pending Design Patent Application having Ser. No. 29/256,992, filed Mar. 27, 2006, the disclosure of which is incorporated herein in its entirety.

In order to crush or pulverize the pill in the pouch, the pill is inserted into the pouch and pressure is applied to the pill. If only one pill for one patient is being crushed, any hard object can be used. However, in institutional work, as noted above, devices have been designed that crush or pulverize pills in pouches by action of an anvil and platen that come together to crush the pill between them.

One such device is shown in U.S. Pat. No. 5,915,637, which operates using a floating pivot point such that movement of the handle moves the platen through an arc to contact with the anvil, and the pill is crushed. The design uses a base, an anvil integral to the base, a handle, a platen and a compression link and all have three moving parts. The platen strikes the pill in the pouch before it is parallel to the anvil, arcing into the pouch as it moves about the pivot. It is possible for portions of the pill to shatter and slide up into the bag opening, thereby spilling. There is also a concern that the use of a pivot may, over time, become out of alignment and the effectiveness. Since all of the pivoting components are in a compact space, the handle, which should not be longer than the base to avoid protruding past the base, the force for crushing is limited by the handle length.

It would be of advantage in the art if a pill crushing device could be provided that contacted the pill in the pouch in a direction perpendicular to the surface against which the force is directed.

Yet another advantage would be if a pill crushing device could be provided that uses fewer moving parts and those parts remain aligned over long periods of use.

It would also be of advantage if a longer handle could be provided.

Still another advantage would be to produce a pill crushing device with few moving parts, for longer life and easier manufacturing time and expense.

Other advantages will appear hereinafter.

SUMMARY OF THE INVENTION

It has now been discovered that the above and other advantages of the present invention may be obtained in the following manner. Specifically, the present invention provides a manually operable pill crusher device for use with pill pouches.

The device includes a base that has a sliding surface. The sliding surface is horizontal and faces upward, and is sized to accept pill pouches such as those now in use in the industry.

A head is mounted on the base and includes a slot that accepts the pill pouch or bag. The slot is configured so that the pill pouch can be inserted with either hand, thus making the device ambidextrous.

A handle is attached to a cam inside the head for movement through a slot in the head that permits the handle to move from a horizontal or at rest position to a vertical or operable position. A bump stop may be provided to support the handle in the at rest position. The handle may also have a knob or grip at the distal end thereof.

The portion of the handle inside the head is fixedly attached to a cam, which simply is a circular disk having a pin that causes the disk to rotate when the handle is moved. The cam is also mounted inside a ram which slideably moves axially inside the head from a raised position in the head when the handle is vertical to a lowered position when the handle is horizontal. The ram includes a crushing surface engaging surface.

A pouch can be inserted on when the handle is raised. Lowering the handle then crushes the pill with axial force directly on the pouch slot, avoiding any cocking or arcuate pressure on the pill. Either or both surfaces on the pouch slot and the ram head that come together when a pouch is engaged may have a textured surface, such as flat/wavy zones, to assist in breaking stubborn pills without concern that the pouch might rupture.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
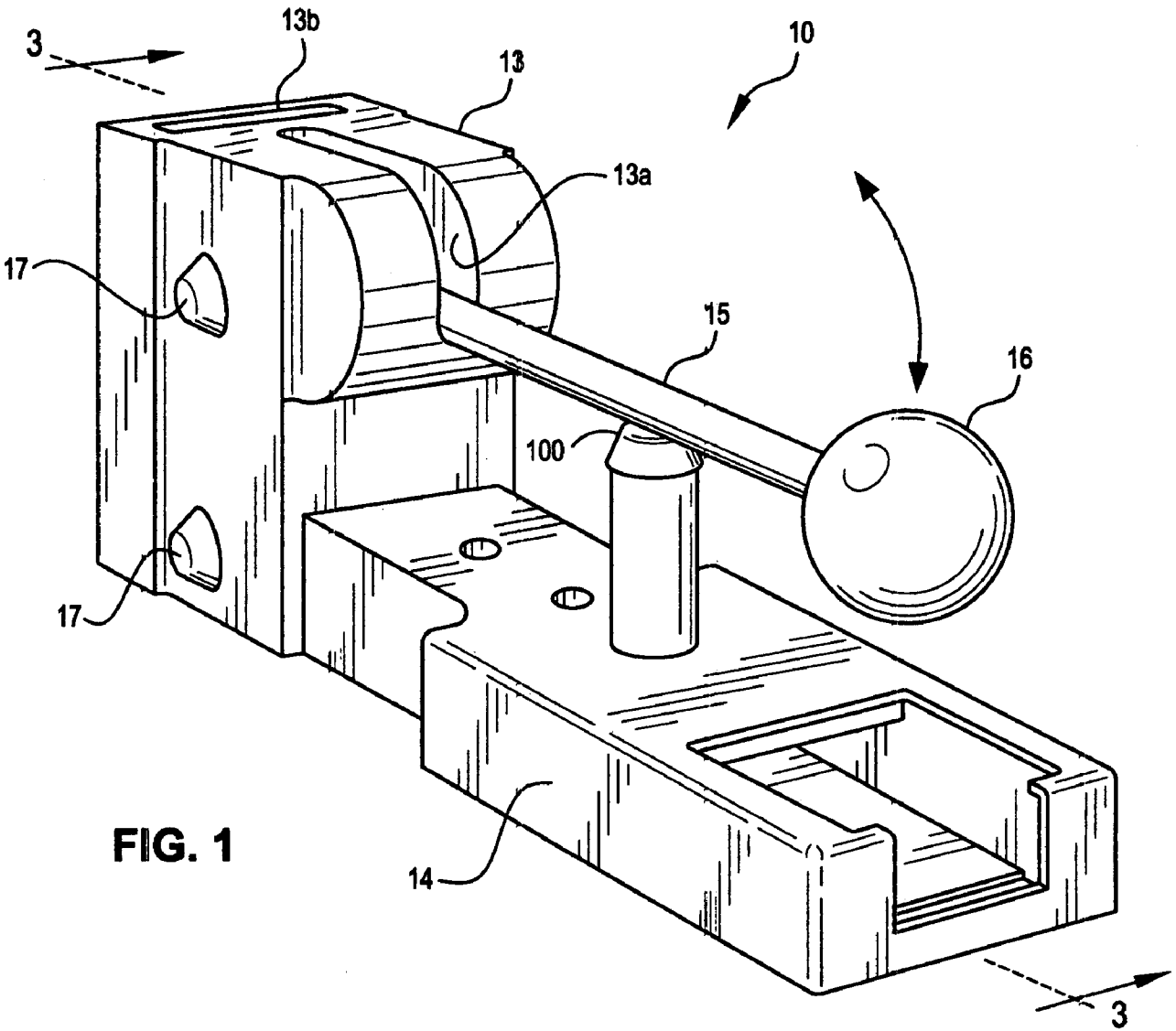
FIG. 1 is a perspective view of the preferred embodiment of the present invention.

The present invention provides for substantial improvements in devices used to crush pills and other similar medicaments inside bags or pouches to render the pill into a powder form for later use, such as by dissolving in liquids or mixing with other ingestible matter.

As shown in the figures, where like numbers denote like elements, the pill crusher device of this invention, 10 generally, includes a base 14 that rests on a table or other horizontal surface, not shown. Base 14 includes a crushing surface 12. A head 13 is mounted on base 14 and is positioned over sliding surface 14*a*. Head 13 includes a slot 13*a* which accommodates handle 15, which optionally includes a grip or ball 16. Ball 16 is larger than the handle and serves to direct the user to use the entire length of the handle during operation thereof.

Figure 2:
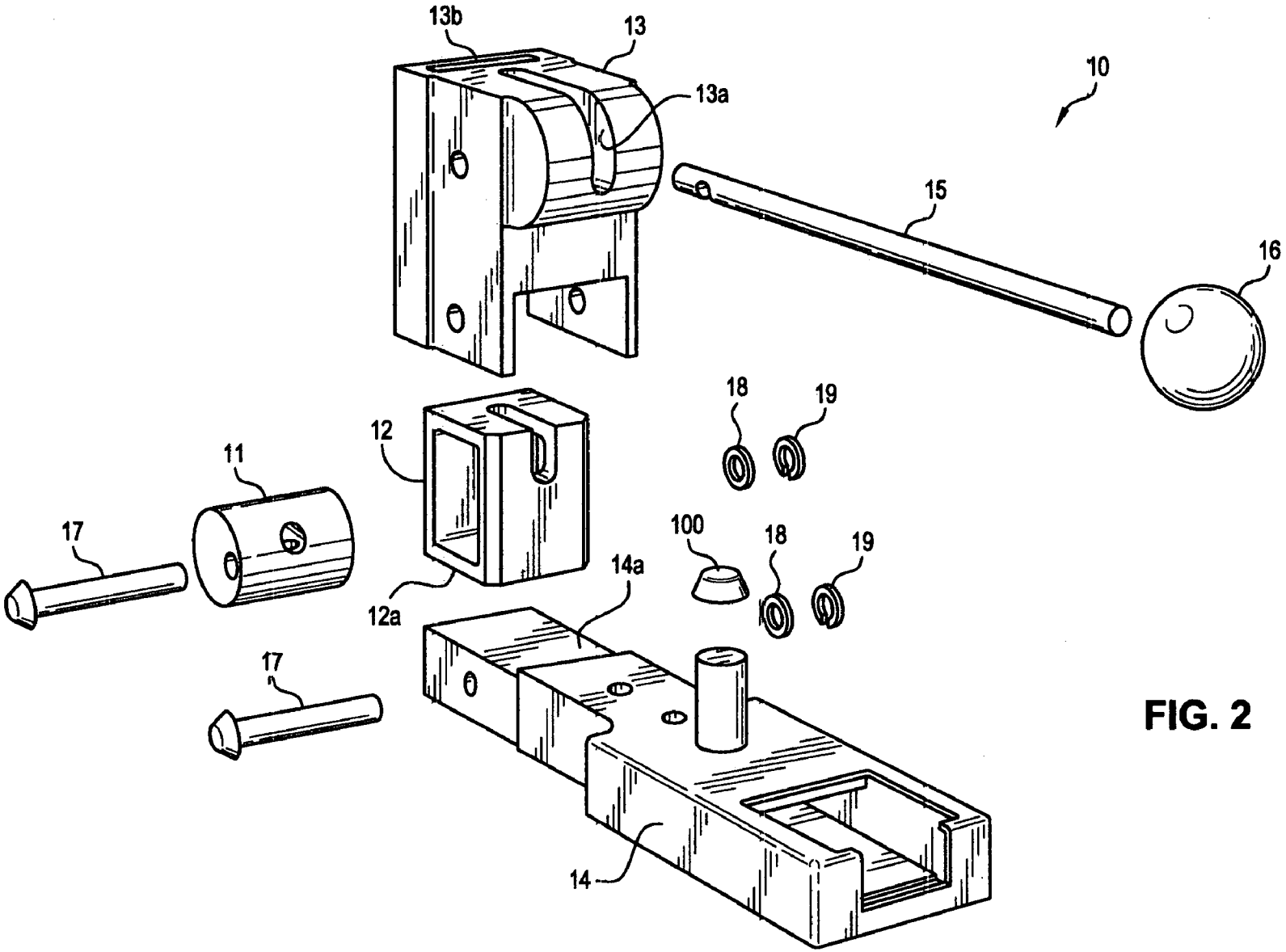
FIG. 2 is an exploded view of the embodiment shown in FIG. 1.
Figure 3:
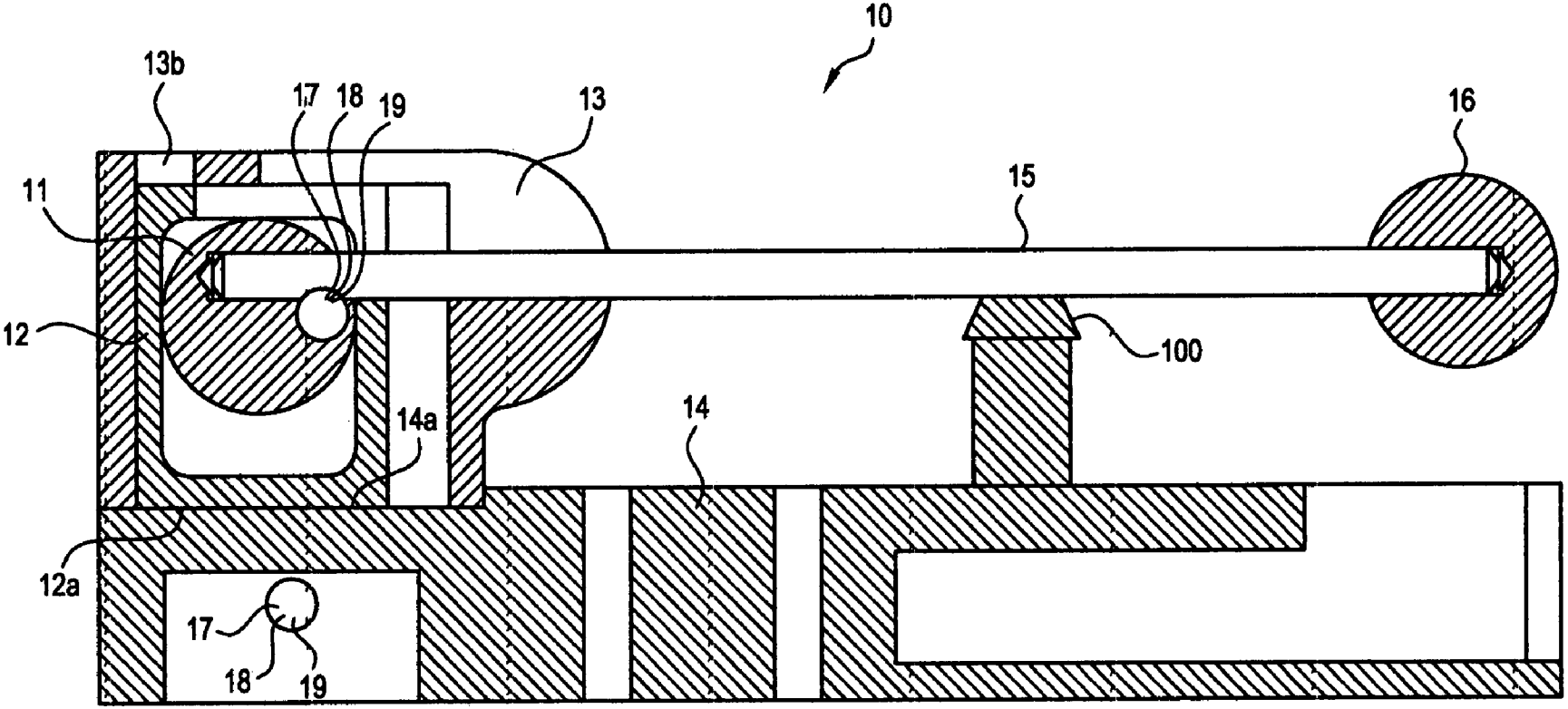
FIG. 3 is a side elevational sectioned view taken along the line 3-3 of the embodiment shown in FIG. 1.

Inside head 13 is a cam 11 that is threaded on to handle 15 so that movement of handle 15 from the horizontal to the vertical causes cam 11 to rotate about pin 17, which pin 17 is off center from cam 11 to provide a cam movement. Cam 11 is also mounted in ram 12 such that when handle 15 is vertical, cam 11 lifts ram 12 along sliding surface 14*a* and space is available for a pill pouch to be placed on crushing surface 12 through slot 13*b*. shown if FIGS. 2 and 3. Ram 12 also has a sliding surface 12*a* and when handle 15 is moved to the horizontal position, the surfaces 14*a* and 12*a* slide over each other as ram 12 moves axially toward surface the back of slot 13*b*.

There is no arcuate movement of the ram, thus insuring that the forces are applied directly over center and there is no cocking action on the bag or pill. Either or both surfaces 12 and the back of slot 13*b* may have a textured surface so that the wavy zones further assist in breaking up stubborn pills.

Cam 11 is extremely simple to manufacture and is both rugged and reliable. No lubrication is needed and tolerances are not critical.

As can be seen, the pill crushing device of the present invention is highly suitable for repetitive pill crushing operations, so that the user can have a plurality of pouches already filled and identified with the contents and person for whom the contents are intended. Taking one pouch at a time, inserting it in slot 13*b*, the handle 15 moves from vertical to horizontal as shown by the arrows, and the pill in the pouch is crushed with direct, axial force. The handle 15 14 is lifted, the pouch removed and replaced on the tray, and the next pouch is inserted. When the desired number of pouches have been processed, the handle is left on bump stop 100.

Because slot 13*a* of head 13 extends horizontally along handle 15 for a distance. slot 13*a* provides lateral strength if handle is accidentally pushed from the side.

While particular embodiments of the present invention have been illustrated and described, it is not intended to limit the invention, except as defined by the following claims.

The invention claimed is:

1. A manually operable pill crusher device for use with pill pouches, comprising:

a base having a predetermined length and includes a sliding surface;

a head is mounted on said base and having a portion facing said sliding surface, said head having an arcuate slot extending from vertically over said sliding surface to perpendicular to said sliding surface;

a pouch slot in said head sized and positioned to permit insertion of a pill pouch therein;

a ram mounted inside said head and having a crushing surface for engaging said pouch slot; and a cam mounted inside said head and attached to said ram;

a handle attached through said slot to said cam at one end and adapted to move in said slot between a horizontal position and a vertical position to cause said cam to thereby axially move said ram between a pouch insertion position and a pouch engaging position.

2. The device of claim 1, wherein said handle further includes a grip portion on the end opposite the cam engaging end.

3. The device of claim 2, wherein said grip portion includes an enlarged portion on its end opposite its end on said cam.

4. The device of claim 1, wherein at least one of said crushing surface and pouch slot engaging said crushing surface includes a textured surface.

5. The device of claim 4, wherein both of said surfaces are textured.

6. The device of claim 1, wherein said pouch slot is positioned to permit access to either hand of a user of said device.

7. The device of claim 1, wherein said slot in said head extends horizontally out from said cam and is sized to prevent movement of said handle when force is applied to said handle from either side thereof.

8. The device of claim 1, wherein said handle extends substantially the length of said base.

9. The device of claim 1, wherein said base further includes a stop facing said handle for supporting said handle in a horizontal position.

10. The device of claim 1, wherein said cam is a cylinder with an offset pin mounting said cam to said handle.

11. A manually operable pill crusher device for use with pill pouches, comprising:

a base having a predetermined length and includes a sliding surface;

a head is mounted on said base and having a portion facing said sliding surface, said head having an arcuate slot extending from vertically over said sliding surface to perpendicular to said sliding surface;

a pouch slot in said head sized and positioned to permit insertion of a pill pouch therein by either hand of a user of said device;

a ram mounted inside said head and having a textured surface for engaging said pouch slot; and a cam mounted inside said head and attached to said ram;

a handle attached through said slot to said cam at one end and adapted to move in said slot between a horizontal position and a vertical position to cause said cam to thereby axially move said ram between a pouch insertion position and pouch engaging position, said handle further including a grip portion on the end opposite the cam engaging end.

12. The device of claim 11, wherein said slot in said head extends horizontally out from said cam and is sized to prevent movement of said handle when force is applied to said handle from either side thereof.

13. The device of claim 11, wherein said base further includes a stop facing said handle for supporting said handle in a horizontal position.

14. The device of claim 11, wherein said cam is cylinder with an offset pin mounting said cam to said handle.

* * * * *